US006722536B2

(12) United States Patent
Bremner et al.

(10) Patent No.: US 6,722,536 B2
(45) Date of Patent: Apr. 20, 2004

(54) NOZZLE FOR DISPENSING VISCOUS MATERIAL

(75) Inventors: Brian M. Bremner, Jersey City, NJ (US); Helen H. Karask, Jersey City, NJ (US); Christine R. Tanner, Jersey City, NJ (US)

(73) Assignee: Smith Kline Beecham Corporation, Philadelphia, PA (US)

( * ) Notice: Subject to any disclaimer, the term of this patent is extended or adjusted under 35 U.S.C. 154(b) by 0 days.

(21) Appl. No.: 10/292,450

(22) Filed: Nov. 13, 2002

(65) Prior Publication Data

US 2003/0209575 A1 Nov. 13, 2003

Related U.S. Application Data

(63) Continuation-in-part of application No. 29/160,525, filed on May 13, 2002, and a continuation-in-part of application No. 29/160,530, filed on May 13, 2002.

(51) Int. Cl.[7] ..... B65D 25/40
(52) U.S. Cl. ..... 222/575; 222/566
(58) Field of Search ..... 222/92, 566, 575

(56) References Cited

U.S. PATENT DOCUMENTS

| | | | | | |
|---|---|---|---|---|---|
| 878,182 | A | * | 2/1908 | Blake | 222/92 |
| D136,098 | S | | 8/1943 | Hartman, Sr. | |
| D179,333 | S | | 11/1956 | Tupper | D58/26 |
| D186,975 | S | | 1/1960 | Werner | D4/3 |
| 3,093,274 | A | | 6/1963 | Galbierz | 222/541 |
| 3,448,896 | A | * | 6/1969 | Kobayashi et al. | 222/92 |
| 3,595,441 | A | | 7/1971 | Grosjean | 222/107 |
| D246,228 | S | | 11/1977 | Hoy | D9/194 |
| D262,094 | S | | 12/1981 | Tiboldo | D9/302 |
| D262,942 | S | | 2/1982 | DiPisa, Sr. | D9/302 |
| D267,927 | S | | 2/1983 | Smith | D9/302 |
| D274,696 | S | | 7/1984 | Marsden | D9/352 |
| D279,548 | S | | 7/1985 | Schildknecht | D9/307 |
| D281,055 | S | | 10/1985 | Dombroski | D9/302 |
| 4,598,839 | A | | 7/1986 | Dombroski et al. | 222/92 |
| D286,504 | S | | 11/1986 | Loesser et al. | D9/302 |
| D286,746 | S | | 11/1986 | Gamble et al. | D9/302 |
| D286,747 | S | | 11/1986 | Kostanecki | D9/302 |
| D291,280 | S | | 8/1987 | Albright | D9/302 |
| D291,964 | S | | 9/1987 | Albright | D9/302 |
| D296,419 | S | | 6/1988 | Terrell | D9/302 |
| D304,791 | S | | 11/1989 | DeVigili | D6/542 |
| 4,896,796 | A | | 1/1990 | Harris | 222/145 |
| D307,543 | S | | 5/1990 | Mileos et al. | D9/302 |
| D308,824 | S | | 6/1990 | Wiseman et al. | D9/370 |
| D311,133 | S | | 10/1990 | Wiseman et al. | D9/370 |
| D316,221 | S | | 4/1991 | Dombroski | D9/302 |
| D319,178 | S | | 8/1991 | Katada et al. | D9/333 |
| D321,127 | S | | 10/1991 | Dombroski | D9/302 |
| D321,130 | S | | 10/1991 | Goberman | D9/370 |

(List continued on next page.)

FOREIGN PATENT DOCUMENTS

| | | |
|---|---|---|
| DE | 1 807 463 | 12/1959 |
| EP | 0 178 377 | 4/1986 |
| FR | 894 043 | 1/1991 |
| FR | DM/040 251 | 5/1997 |
| FR | DM/047 678 | 5/1999 |
| FR | DM/049 424 | 10/1999 |

*Primary Examiner*—Gene Mancene
*Assistant Examiner*—Melvin A Cartagena
(74) *Attorney, Agent, or Firm*—Finnegan, Henderson, Farabow, Garrett & Dunner, L.L.P.

(57) ABSTRACT

A nozzle for dispensing a viscous material from a source of the viscous material. The nozzle includes a dispensing orifice, a nozzle throat in flow communication with that orifice; and a transition in flow communication with the nozzle throat and the source of viscous material. These portions of the nozzle have a specific size relationship.

21 Claims, 5 Drawing Sheets

U.S. PATENT DOCUMENTS

D321,453 S 11/1991 Ophardt ..... D7/300
D322,392 S 12/1991 Schneider et al. ..... D9/300
D324,806 S 3/1992 Van Arman ..... D9/302
D324,994 S 3/1992 Jentgen ..... D9/302
D325,339 S 4/1992 Jones ..... D9/302
D328,246 S 7/1992 Nottingham et al. ..... D9/520
D329,379 S 9/1992 Jorgensen et al. ..... D9/434
5,174,458 A 12/1992 Segati ..... 215/1 C
D337,261 S 7/1993 Sherman ..... D9/302
D342,442 S 12/1993 Smith ..... D9/302
D342,443 S 12/1993 Smith ..... D9/302
D342,444 S 12/1993 Smith ..... D9/302
D343,358 S 1/1994 Lay et al. ..... D9/449
D344,888 S 3/1994 Linner ..... D9/302
D346,549 S 5/1994 Smith ..... D9/306
D347,168 S 5/1994 Smith ..... D9/306
D347,995 S 6/1994 Schurig ..... D9/306
5,324,505 A 6/1994 Kornettka et al. ..... 424/49
D348,829 S 7/1994 Hallas ..... D9/302
D349,449 S 8/1994 Linnér ..... D9/302
D351,101 S 10/1994 Linnér ..... D9/302
D351,338 S 10/1994 Koptis ..... D9/302
D352,458 S 11/1994 Gray ..... D9/520
D353,325 S 12/1994 Chura et al. ..... D9/337
D353,329 S 12/1994 Mangold ..... D9/521
D353,539 S 12/1994 Linnér ..... D9/447
D356,026 S 3/1995 Iaia et al. ..... D9/302
D358,760 S 5/1995 Sherman et al. ..... D9/302
D362,616 S 9/1995 Linnér ..... D9/302
D362,617 S 9/1995 Linnér ..... D9/302
D363,428 S 10/1995 Halm ..... D9/302
D364,557 S 11/1995 Linner ..... D9/302
D366,151 S 1/1996 Norris ..... D4/116
D367,224 S 2/1996 Schurig et al. ..... D9/302
D367,606 S 3/1996 Linner ..... D9/302
D369,094 S 4/1996 Linner ..... D9/302
D373,722 S 9/1996 Kastberg ..... D9/337
D374,173 S 10/1996 Linner ..... D9/302
D374,615 S 10/1996 Kani ..... D9/302
D375,256 S 11/1996 Chadfield ..... D9/302
D376,100 S 12/1996 Beaver ..... D9/302
5,588,560 A 12/1996 Benedict et al. ..... 222/106
D378,350 S 3/1997 Halm ..... D9/302
D378,718 S 4/1997 Daansen ..... D6/542
D392,879 S 3/1998 Couey ..... D9/302
5,813,573 A 9/1998 Battegazzore ..... 222/135
D399,417 S 10/1998 Meausoone ..... D9/302
D399,423 S 10/1998 Palestrant ..... D9/447
5,823,387 A 10/1998 Manadanas et al. ..... 222/1
D402,194 S 12/1998 Zaksensberg ..... D9/302
D403,544 S 1/1999 Wilkinson ..... D6/542
D404,296 S 1/1999 Durliat et al. ..... D9/302
D405,354 S 2/1999 Meausoone ..... D9/302
5,868,323 A 2/1999 Cantor ..... 239/589
D406,482 S 3/1999 Kerr ..... D6/542
D409,481 S 5/1999 Smith et al. ..... D9/302
5,899,361 A 5/1999 Durliat et al. ..... 222/92
D412,834 S 8/1999 Benedict et al. ..... D9/302
D413,063 S 8/1999 Bell et al. ..... D9/434
D415,643 S 10/1999 Wilkinson ..... D6/542
D416,154 S 11/1999 Diehl ..... D6/542
D416,477 S 11/1999 Flint ..... D9/306
D419,057 S 1/2000 Gobe
D430,008 S 8/2000 Gobe ..... D9/302
6,524,103 B1 * 2/2003 Winkler et al. ..... 433/90

* cited by examiner

NOZZLE FOR DISPENSING VISCOUS MATERIAL

CROSS REFERENCE TO RELATED APPLICATIONS

The present application is a continuation-in-part of U.S. patent application Ser. No. 29/160,525, filed May 13, 2002, entitled A NOZZLE FOR DISPENSING VISCOUS MATERIAL, and U.S. patent application Ser. No. 29/160,530, also filed May 13, 2002, entitled A NOZZLE FOR DISPENSING VISCOUS MATERIAL. The entire content of these applications is specifically incorporated by reference herein.

FIELD OF THE INVENTION

The present invention relates to nozzles for dispensing viscous material from pliable containers.

BACKGROUND OF THE INVENTION

A number of viscous materials are dispensed from collapsible containers where the pressure for dispensing the viscous material is generated by applying pressure to a pliable container. The shape of the material issuing from the container is determined by the cross-sectional shape of the nozzle forming the open end of such containers. The viscous material within the container flows under the influence of the pressure generated by collapsing the container toward the nozzle, and is extruded therefrom through the nozzle and its dispensing orifice. The cross-sectional shape of the extruded viscous material is determined by a cross-sectional shape of the dispensing orifice.

The prior art shows a number of nozzle orifice configurations and while most of the prior art orifices are circular, forming a cylindrical extrudate of the viscous material being dispensed, a great many different shapes have been used for nozzle orifices. See for example the interior nozzle orifices of FIGS. 4 through 7 of U.S. Pat. No. 5,823,387 to Manadanas, et al. Elongated dispensing orifices are disclosed in a number of references, including European Patent Application 01 78 377 A2.

Aside from the configuration of the dispensing orifice in a nozzle structure for dispensing a viscous material, the nozzle structure must be such that the pressure generated from collapsing the container, usually hand pressure, is sufficient to extrude an adequate amount of viscous material from the dispensing nozzle, with a shape and at a rate that is suitable for the particular application.

In addition, the nozzle structure should be capable of being formed in conventional molding apparatus with tooling that is not inordinately expensive to manufacture.

SUMMARY OF THE INVENTION

To solve these and other problems in the prior art, there is provided a nozzle for dispensing a viscous material from a source of the viscous material. The nozzle includes a dispensing orifice, a nozzle throat in flow communication with that orifice, and a transition in flow communication with the nozzle throat and the source of viscous material. The source of the viscous material is a container having an interior cross-sectional area, at the interface of the source and transition, of a value A. The transition has a cross-sectional area, at the interface with the nozzle throat, of a value B. The dispensing orifice has a cross-sectional area, in a plane perpendicular to flow through the orifice of a value C. Where the nozzle includes a generally rectangular, "race track," or elliptical dispensing orifice, A is in the range of from 2 to 3 of B and B is in the range of from 25 to 35 of C.

Nozzles having such configurations are capable of dispensing viscous material in a desired shape, at acceptable rates, without excessive pressure being developed in the container. Moreover, such nozzles can be fabricated and attached to the containers in automated machinery that need not include complex tooling.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DETAILED DESCRIPTION OF THE PREFERRED EMBODIMENTS

Reference will now be made in detail to the present preferred embodiments of the invention, examples of which are illustrated in the accompanying drawings. Wherever possible, the same reference numbers are be used throughout the drawings to refer to the same or like parts.

In accordance with the invention, there is a nozzle for dispensing viscous materials. Such materials may include adhesives, caulk, toothpaste, dental adhesive, food products, pigments, or the like. The purpose of the nozzle is to dispense the viscous material in a shape, and at such a rate, as to facilitate the efficient and effective delivery of the viscous material to a receiving surface. The source of such material is a container.

Figure 1:
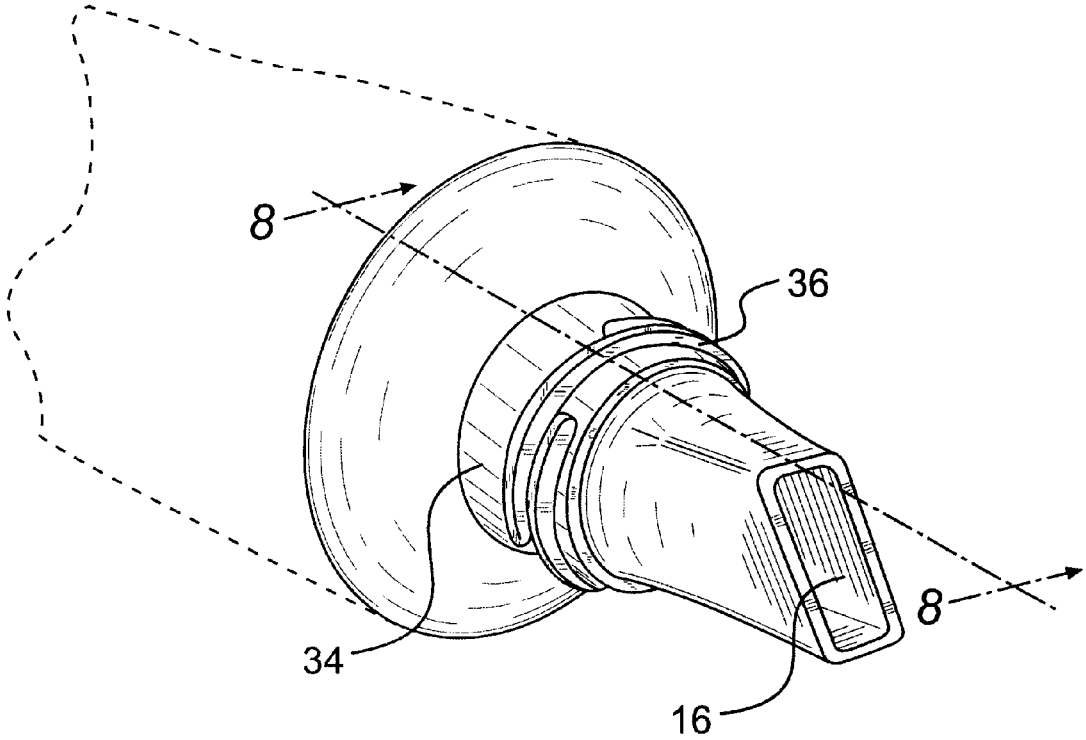
FIG. 1 is a left perspective view of one embodiment of the present invention having a generally rectangular nozzle orifice truncated at an angle to the general direction of flow from the nozzle.

As here embodied, and shown in FIG. 1, the container is a tube 10 having a closed end 12 opposite the nozzle 14. The configuration of the container is not critical to the present invention. The container can be a cylindrical tube with a movable end that is advanced to create pressure on the viscous material in the container, a tube that is collapsible under the influence of external pressure, or any source of viscous material that can generate pressure to force the viscous material out of the container toward the nozzle.

In accordance with the invention, there is included a nozzle that includes a dispensing orifice. As here embodied, and depicted in FIGS. 1–4 and 8, there is a nozzle 14 having a nozzle orifice 16 that is generally rectangular with radiused corners 18. The radius of curvature is not known to be critical, however, without radiused corners (i.e. sharp, square corners) the flow rate in such sharp corners is significantly lower that in the remainder of the nozzle orifice and viscous material can accumulate in such sharp corners. For that reason, it is preferred that the corners of a nozzle orifice that is generally rectangular have radiused corners, as is most clearly depicted in FIGS. 3 and 4. In some embodiments (not shown) the opposite short ends of the rectangular orifice have a radius equal to one-half of the dimension across the end, a so called "race track" shape.

In embodiments where the extremity of the nozzle is truncated at an angle to the flow of viscous material passing through the orifice, the cross sectional area of the orifice is measured (for purposes of comparison with other cross sectional areas in the apparatus) in a direction perpendicular to the passage through the nozzle.

In a preferred embodiment, the generally rectangular nozzle opening has a length to width ratio in the range of from 1.8 to 2.2. A most preferred embodiment has radiused corners, with a radius less than one half of the width of the orifice, and a length to width ratio of 1.96.

Where the pressure in the viscous material is relatively low and the viscous material is not significantly compressible, the shape of the nozzle orifice determines the shape of the material being dispensed.

Figure 5:
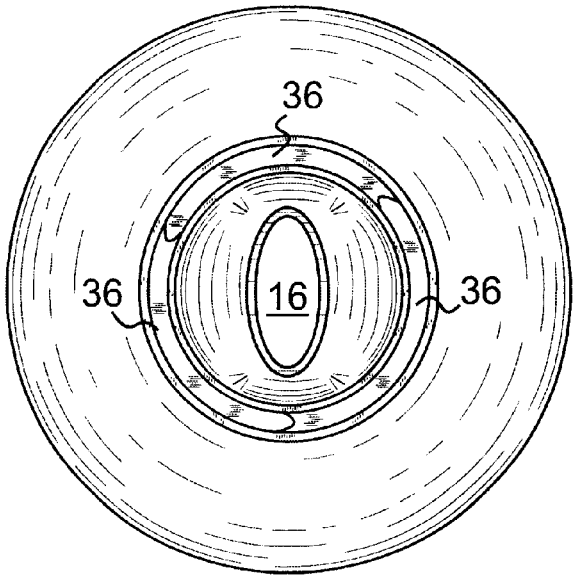
FIG. 5 is an end view toward the nozzle orifice of another embodiment, where the nozzle orifice is elliptical.
Figure 6:
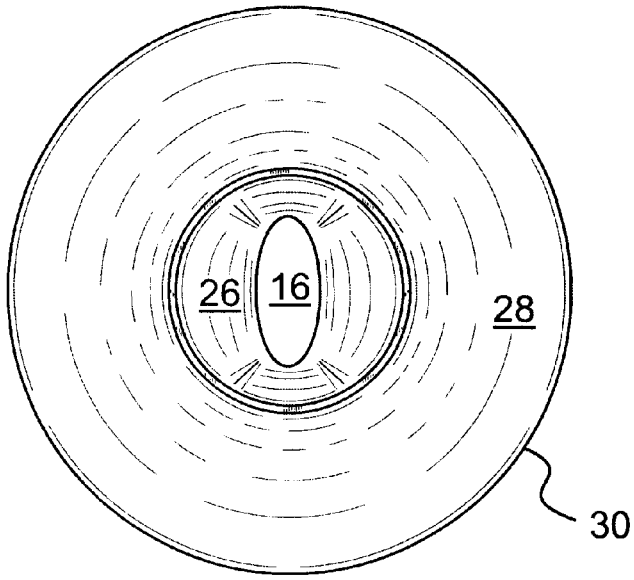
FIG. 6 is a view from inside a container toward the nozzle orifice the embodiment of FIG. 5.
Figure 7:
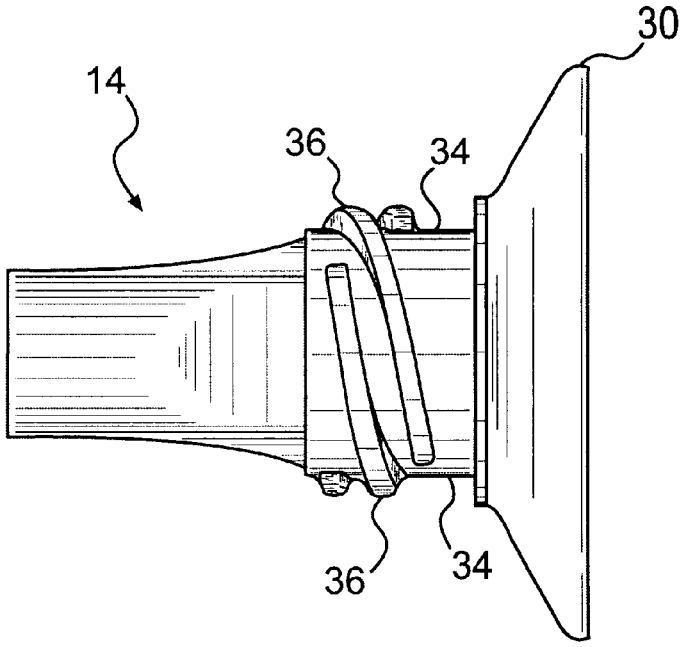
FIG. 7 is a side view of the embodiment of FIG. 5.
Figure 8:
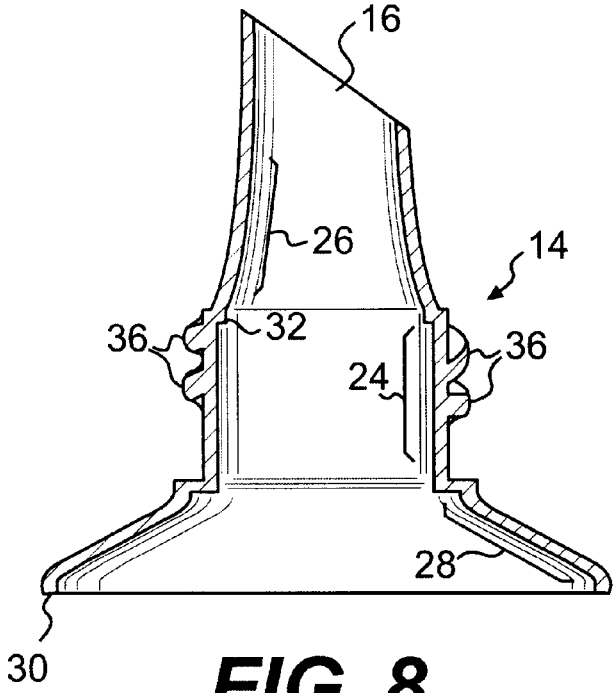
FIG. 8 is a cross-sectional view of the embodiment of FIG. 1.

As here embodied and depicted in FIGS. 5 and 6, the nozzle orifice 16 is elliptical in cross section. In a preferred embodiment, the elliptical nozzle opening has a minor axis (the smaller interior dimension 20) about 50% of the minor axis (the larger interior dimension 22) of the elliptical orifice.

In accordance with the invention, the nozzle of the present invention includes a nozzle throat in flow communication with the nozzle orifice. As here embodied, and most clearly depicted in FIG. 8, the nozzle 14 includes a nozzle throat 24 in flow communication through channel 26 to the orifice 16.

In accordance with the invention, the nozzle includes a transition in flow communication with the nozzle throat and the source of viscous material. As here embodied and depicted in FIG. 8, the nozzle 14 includes the transition 28 that, at one extremity (the nozzle throat 24) interfaces with the channel 26, and at the opposite extremity (nozzle entrance 30) it interfaces with the container 10.

In accordance with the invention, the dispensing nozzle orifice has a cross-sectional area (measured perpendicular to the flow of viscous material through the nozzle) of a value C. As here embodied, the nozzle orifice 16 has a cross-sectional area of C.

In accordance with the invention, the transition has a cross-sectional area at the interface with said nozzle throat of B. As here embodied, and most clearly depicted in FIG. 8, the transition 28 is adjacent to nozzle throat 24, and the nozzle throat 24 has a cross sectional area of B. The opposite extremity of the transition 28 interfaces with the container 10 at nozzle entrance 30.

In accordance with the invention, the source of viscous material comprises a container having an interior cross-sectional area at the interface of the source and the transition in the nozzle of A. As here embodied, and depicted in FIG. 8, the tube 10 has a nozzle entrance 30 having a cross-sectional area of A.

In the embodiment where the dispensing orifice is generally rectangular, the value of A is in the range of from 2 to 3 of B, and the value of B is in the range of from 25 to 30 of C. In a preferred embodiment where the viscous material is either dental adhesive or toothpaste, it is preferred that A is about 3.4 $in^2$, B is about 1.35 $in^2$, and C is about 0.0254 $in^2$.

In a preferred embodiment the nozzle throat has a substantially constant cross-sectional area along the longitudinal axis of the nozzle. As here embodied, and shown in FIG. 8 the nozzle includes and interior nozzle throat 24 that extends along the longitudinal axis of the nozzle 14. As here embodied the nozzle throat includes a step 32 that facilitates the manufacture of the tooling that forms the nozzle without interfering significantly with the flow of viscous material through the nozzle. As here embodied the interior surface of the nozzle includes a smooth channel 26 transitioning in a taper from the cylindrical nozzle throat 24 to the dispensing orifice 16. The channel 26 need not be entirely tapered and in FIG. 8 the last portion of the channel 26 has generally parallel sides.

Figure 2:
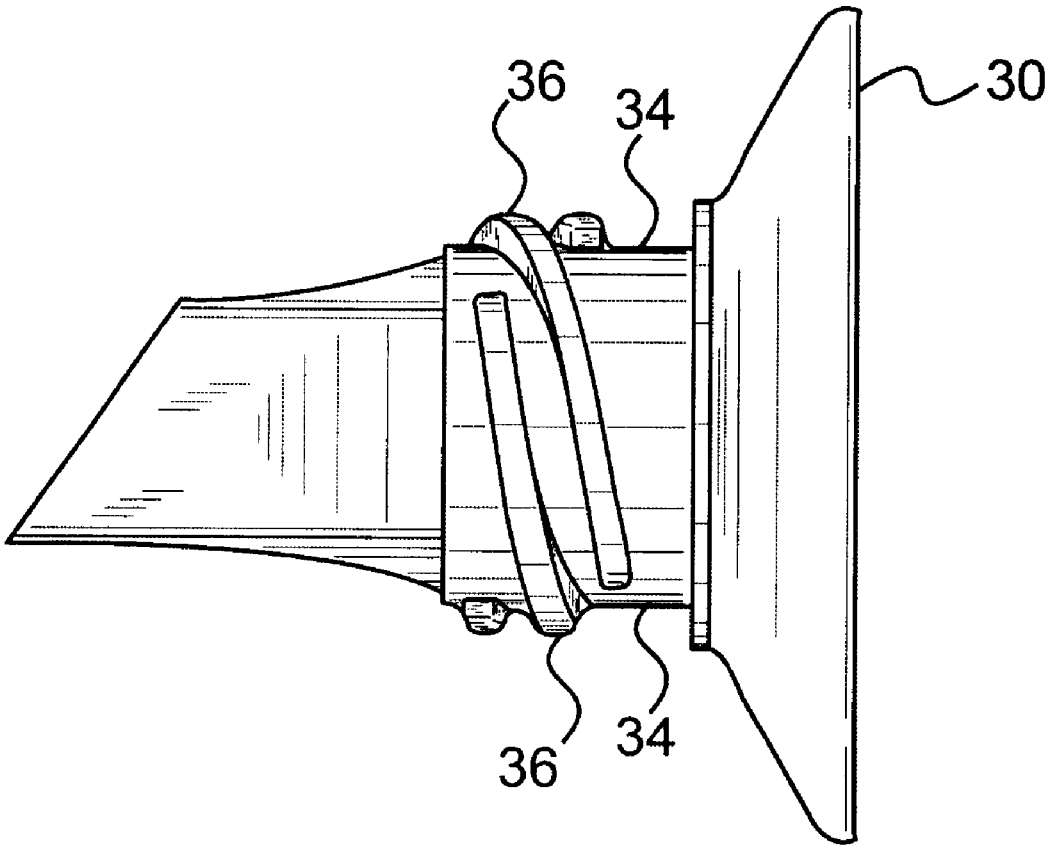
FIG. 2 is a side view of the embodiment of FIG. 1.

As shown in FIG. 2, the dispensing orifice need not be perpendicular to the flow of viscous material through the nozzle. As here embodied, the dispensing orifice is at an angle of greater than ninety degrees to the direction of flow of the viscous material. This can also be the case where the nozzle orifice is circular or elliptical.

Figure 3:
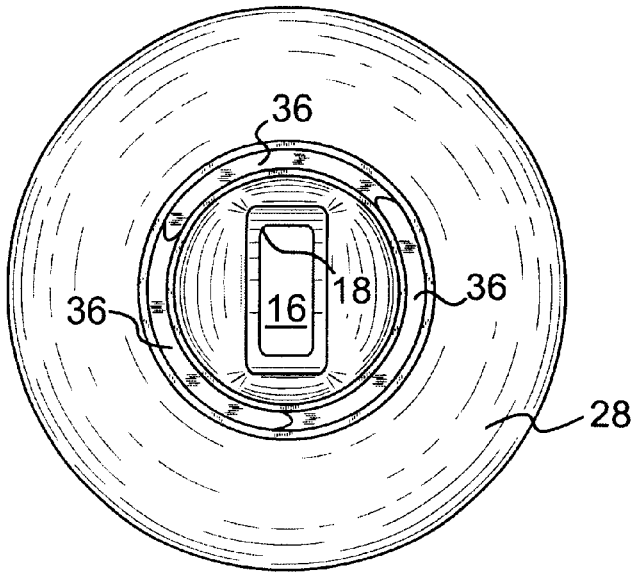
FIG. 3 is an end view toward the rectangular nozzle orifice of the embodiment of FIG. 1.
Figure 4:
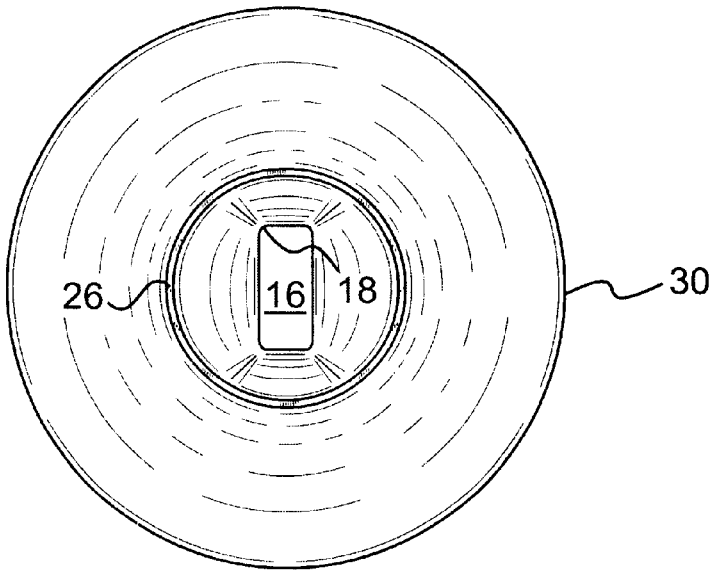
FIG. 4 is a view from inside the container toward the rectangular nozzle orifice of the embodiment of FIG. 1.

As here embodied, the nozzle includes a substantially cylindrical exterior surface 34 between the transition 28 and the dispensing orifice 16. That surface 34 includes a plurality of threads 36. In this embodiment, the threads comprise three generally parallel threads 36, each thread starting at a location around the circumference of the cylindrical exterior surface at angularly spaced starting points. It is preferred (and is shown in FIGS. 3 and 5) that the angularly spaced starting points are spaced 120 degrees around the circumference. It is further preferred that the plurality of threads have a pitch of 0.25 (4 threads per inch) and extend approximately 200 degrees around the circumference of the cylindrical exterior surface 34.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A nozzle for dispensing a viscous material from a source of said material, said nozzle comprising:

a generally rectangular dispensing orifice;

a nozzle throat in flow communication with said nozzle orifice; and a transition in flow communication with said nozzle throat and said source of said material;

whereas said source comprises a container having an interior cross-sectional area at the interface of said source and said transition of A, said transition having a cross-sectional area at the interface with said nozzle throat of B, said dispensing orifice having a cross-sectional area, in a plane perpendicular to flow through said orifice of C, where:

A is in the range of from 2 to 3 of B, and

B is in the range of from 25 to 30 of C.

2. The nozzle of claim 1 wherein said viscous material comprises dental adhesive and A is about 3.4 $in^2$, B is about 1.35 $in^2$, and C is about 0.0254 $in^2$.

3. The nozzle of claim 1 wherein said viscous material comprises toothpaste and A is about 3.4 $in^2$ B is about 1.35 $in^2$ and C is about 0.0254 $in^2$.

4. The nozzle of claim 1 wherein the extremity of said orifice is at an angle of greater than ninety degrees to the direction of flow of said viscous material.

5. The nozzle of claim 1 wherein the cross-sectional area of said orifice is in the range of from 0.02 to 0.03 $in^2$.

6. The nozzle of claim 1 wherein the interior corners of said generally rectangular orifice are radiused.

7. The nozzle of claim 1 wherein said nozzle throat has a substantially constant cross-sectional area along the longitudinal axis of said nozzle.

8. The nozzle of claim 1 wherein said nozzle includes a substantially cylindrical exterior surface between said container and said dispensing orifice.

9. The nozzle of claim 8 wherein said substantially cylindrical exterior surface includes a plurality of threads.

10. The nozzle of claim 9 wherein said plurality of threads comprise three generally parallel threads, each thread starting at a location around the circumference of said cylindrical exterior surface at angularly spaced starting points.

11. The nozzle of claim 10 wherein angularly spaced starting points are spaced 120 degrees around said circumference.

12. The nozzle of claim 9 wherein said plurality of threads have a pitch of 0.25 (4 threads per inch).

13. The nozzle of claim 9 wherein said plurality of threads comprise three generally parallel threads extending approximately 200 degrees said circumference of said cylindrical exterior surface.

14. The nozzle of claim 1 wherein the width to length ration of said orifice is about 50%.

15. A nozzle for dispensing a viscous material from a source of said material, said nozzle comprising:

a generally rectangular dispensing orifice, wherein the interior corners of said generally rectangular orifice are radiused;

a nozzle throat in flow communication with said nozzle orifice; wherein said nozzle throat has a substantially constant cross-sectional area along the longitudinal axis of said nozzle and a transition in flow communication with said nozzle throat and said source of said material;

whereas said source comprises a container having an interior cross-sectional area at the interface of said source and said transition of A, said transition having a cross-sectional area at the interface with said nozzle throat of B, said dispensing orifice having a cross-sectional area, in a plane perpendicular to flow through said orifice of C, where:

A is in the range of from 2 to 3 of B, and

B is in the range of from 25 to 30 of C wherein said nozzle includes a substantially cylindrical exterior surface between said container and said dispensing orifice, said substantially cylindrical exterior surface includes a plurality of threads, each thread starting at a location around the circumference of said cylindrical exterior surface at angularly spaced starting points.

16. The nozzle of claim 15 wherein said plurality of threads comprise three generally parallel threads having angularly spaced starting points spaced 120 degrees around said circumference.

17. The nozzle of claim 15 wherein said plurality of threads have a pitch of 0.25 (4 threads per inch).

18. The nozzle of claim 17 wherein said plurality of threads comprise three generally parallel threads extending approximately 200 degrees said circumference of said cylindrical exterior surface.

19. A nozzle for dispensing a viscous material from a source of said material, said nozzle comprising:

a generally elliptical dispensing orifice;

a nozzle throat in flow communication with said nozzle orifice; and a transition in flow communication with said nozzle throat and said source of said material;

whereas said source comprises a container having an interior cross-sectional area at the interface of said source and said transition of A, said transition having a cross-sectional area at the interface with said nozzle throat of B, said dispensing orifice having a cross-sectional area, in a plane perpendicular to flow through said orifice of C, where:

A is in the range of from 2 to 3 of B, and

B is in the range of from 25 to 30 of C.

20. The nozzle of claim 19 wherein the extremity of said orifice is at an angle of greater than ninety degrees to the direction of flow of said viscous material.

21. The nozzle of claim 19 wherein the minor axis of said elliptical orifice is about 50% of the major axis of said elliptical orifice.

* * * * *